US005351812A

United States Patent [19]

Eagon

[11] Patent Number: 5,351,812

[45] Date of Patent: Oct. 4, 1994

[54] PALETTE CASE

[76] Inventor: Colleen M. Eagon, 1506 N. B St., Aberdeen, Wash. 98520

[21] Appl. No.: 957,279

[22] Filed: Oct. 6, 1992

[51] Int. Cl.[5] ..... B05C 17/00; B44D 3/00

[52] U.S. Cl. ..... 206/1.7; 206/818; 220/230

[58] Field of Search ..... 206/818, 1.7, 1.8, 1.9; 220/230

[56] References Cited

U.S. PATENT DOCUMENTS

| | | | |
|---|---|---|---|
| 2,515,703 | 7/1950 | Dumas | 41/4 |
| 2,932,545 | 4/1960 | Foley | 206/818 X |
| 2,959,832 | 11/1960 | Baermann | 206/818 X |
| 3,352,616 | 11/1967 | Linger | 312/231 |
| 3,650,589 | 3/1972 | Linger | 312/231 |
| 3,672,742 | 6/1972 | Barg | 312/232 |
| 3,813,815 | 6/1974 | Baermann | 49/478 |
| 3,945,490 | 3/1976 | Thompson | 206/1.7 |
| 4,110,552 | 8/1978 | Lombardi | 220/230 |
| 4,638,909 | 1/1987 | Ford | 206/1.7 |
| 4,901,850 | 2/1990 | McIntosh | 206/205 |
| 5,135,012 | 8/1992 | Kamen et al. | 206/818 X |

FOREIGN PATENT DOCUMENTS

| | | | |
|---|---|---|---|
| 125520 | 7/1949 | Sweden | 206/1.7 |
| 1161277 | 8/1969 | United Kingdom | 206/1.7 |

*Primary Examiner*—William I. Price

*Attorney, Agent, or Firm*—Christensen, O'Connor, Johnson & Kindness

[57] ABSTRACT

A palette case is provided with a gasket and magnets to create a controlled humidity environment for the temporary storage of wet paints and other materials on a palette. First and second case portions form an enclosure for storage of the palette when the case is closed. A gasket is disposed between the first and second case portions around the entire periphery of the enclosure, and two magnets, or a magnet and ferric metal, are disposed on the first and second case portions, respectively, around the periphery of the enclosure. The case may be provided with one or more storage compartments for brushes, paint tubes, and other supplies. These storage compartments are covered by the stored palette.

14 Claims, 3 Drawing Sheets

PALETTE CASE

FIELD OF THE INVENTION

The present invention relates to a case for carrying art supplies, and more particularly to a case that provides a controlled humidity environment for the temporary storage of paint on an artist's palette.

BACKGROUND OF THE INVENTION

Artists typically use a palette during painting and often are faced with the difficulty of preserving paints and other materials that remain on the palette. As a matter of conservation, as well as cost, it is desired to protect the materials from drying out so as to preserve them for later use. Moreover, it is difficult to remove dried paints from a palette, so presentation of wet paints is desirable.

It is known to provide substantially airtight cases for carrying a palette having paint and other materials spread on the palette. However, these cases have relatively complex constructions that render them more vulnerable to failure, more difficult to use, and more costly to manufacture. For example, U.S. Pat. No. 3,352,616 to Linger describes a combination palette and carrying case in which the palette is held within the case by a number of latches. In order to form an airtight chamber for preserving materials stored on the palette, the palette is forced against a gasket by a spring clamp. To remove the palette from the case, a user must undo the latches and then release the spring clamp. To store the palette, a user must fasten the spring clamp and close the latches. If the spring clamp or one of the latches fails, the seal is broken.

U.S. Pat. No. 3,650,589 to Linger describes a combination palette and artist's case in which a substantially airtight chamber for paints is formed by disposing a gasket between the case and the palette. The palette comprises two sheet metal members welded together and hermetically sealed and edge trimmed by a trim member so that both sides of the palette are usable. Spring clamps are used to secure the palette trim member against the gasket. Hence, the palette, and thus the gasket, are forced against the case to form a substantially airtight seal by the spring clamps. In order to move the palette to and from the stored position, a user must operate the spring clamps. If one of the spring clamps fails, then the seal is broken.

U.S. Pat. No. 2,515,703 to Dumas describes a painter's box in which a substantially airtight chamber for paints is formed by disposing a gasket between the box cover and a peripheral up-turned flange of the palette. Resilient supports having spring-loaded plungers urge the palette against the gasket. Latches are used to keep the case closed. In order to store the palette, a user must close the latches against the force of the spring-loaded plungers. If one of the spring-loaded plungers or latches fails, the seal is broken.

A palette case that provides a reliable, substantially airtight seal and has a simple construction is desirable.

SUMMARY OF THE INVENTION

The present invention is a palette case that provides a reliable, substantially airtight seal and has a simple and durable construction. The case comprises first and second case portions that when joined together form an enclosure for storage of a palette. A gasket is disposed between the first and second case portions around the periphery of the palette storage enclosure. A magnet is provided around the entire periphery of the palette storage enclosure on at least one of the first and second case portions. The other case portion is provided with either an oppositely polarized magnet or ferric metal around the entire periphery of the palette storage enclosure. When the case is closed, the magnet-to-magnet attraction or magnet-to-ferric metal attraction holds the first and second case portions in contact with the gasket from opposite sides thereof to form a substantially airtight seal. In this manner, a controlled humidity environment that enables the temporary storage of wet paints and other materials on the palette is created. Fastening of the first and second case portions to form a substantially airtight seal is achieved entirely through the magnetic elements. The use of latches, spring-loaded members, or other mechanisms is not required.

The first case portion may be provided with storage compartments for brushes, paint tubes, and other supplies. In this configuration, the stored palette is detachably secured inside the case by hooks and loops fasteners and serves as a cover for the storage compartments.

BRIEF DESCRIPTION OF THE DRAWINGS

The present invention will be described with reference to the accompanying drawings, wherein.

DETAILED DESCRIPTION OF THE PREFERRED EMBODIMENTS

Figure 3:
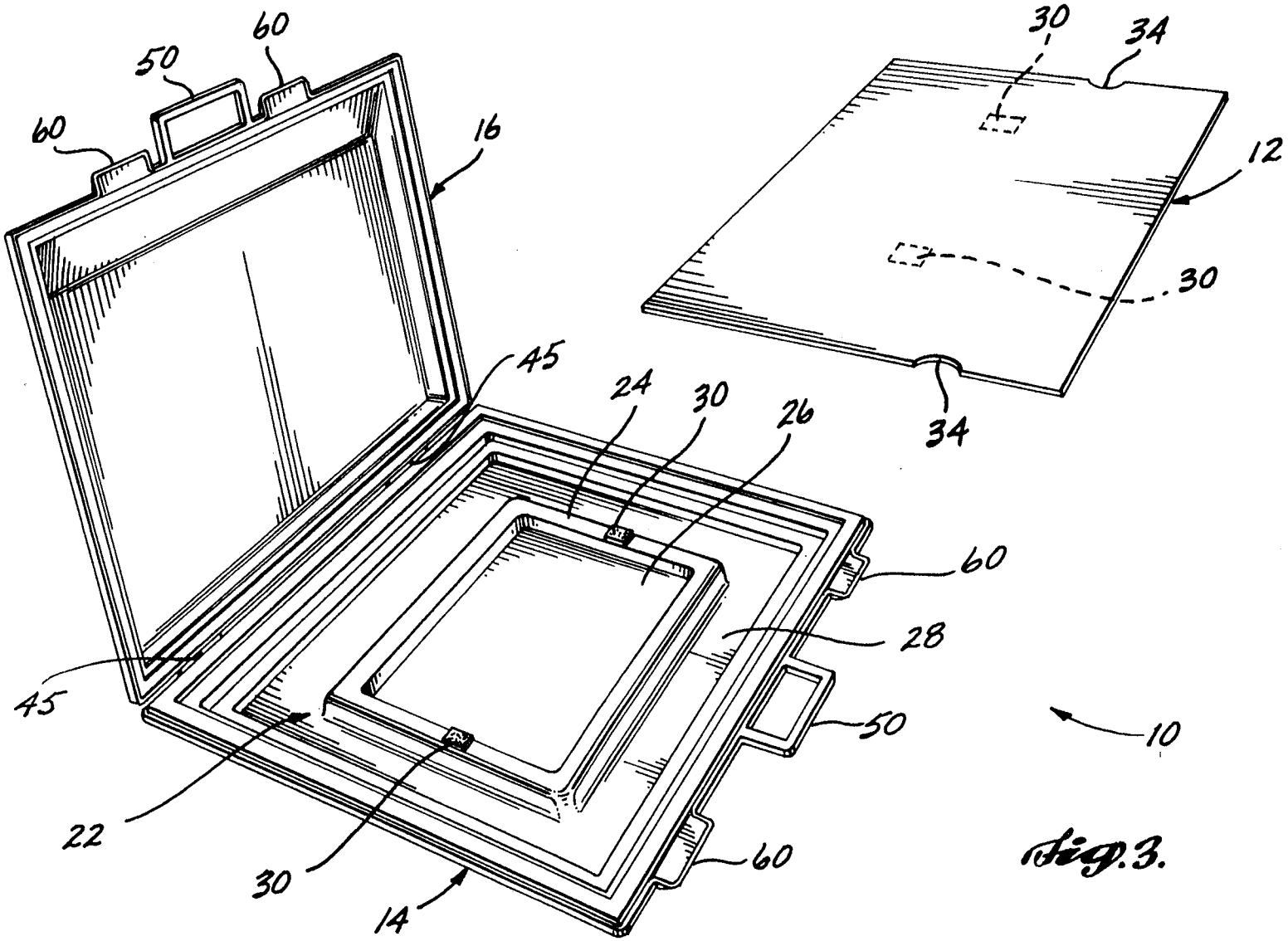
FIG. 3 is a perspective view of the case illustrated in FIG. 1, with the case being opened and the palette removed.
Figure 4:
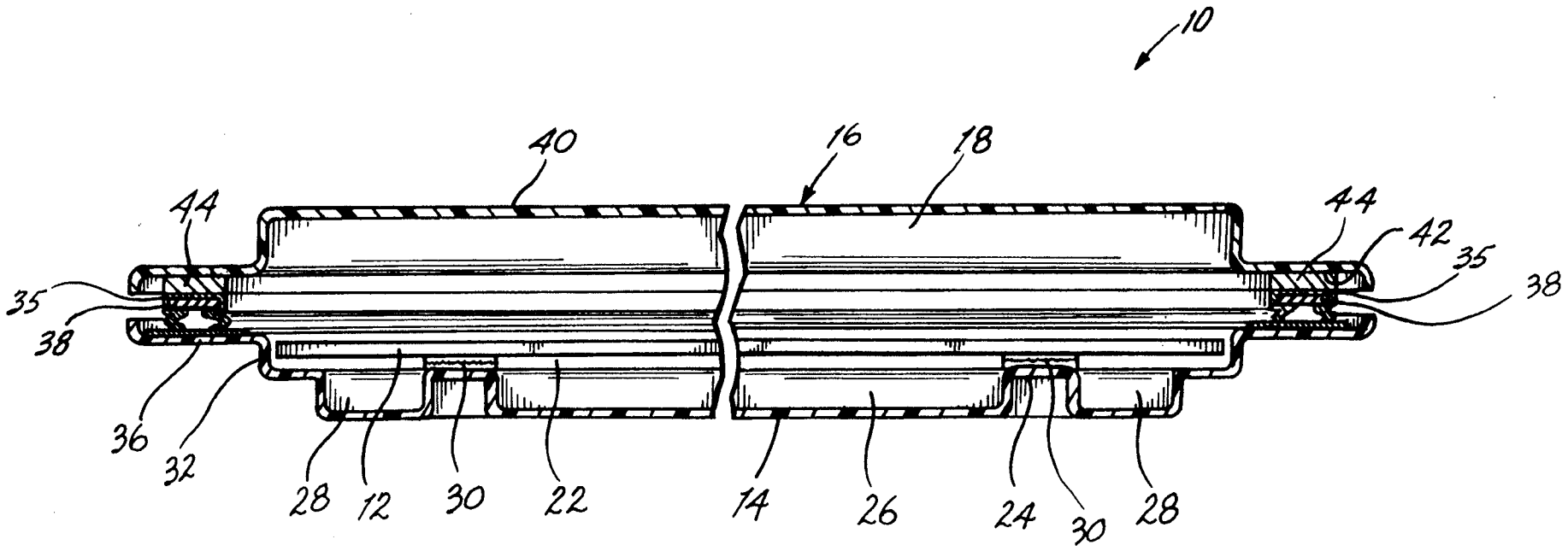
FIG. 4 is a partially cutaway side view of the case illustrated in FIG. 1, taken along the line 4—4 in FIG. 1.

The present invention is a substantially airtight palette case 10 that enables the storage of wet paints and other materials on a palette 12, thereby allowing materials to be conserved for later use. As shown in FIGS. 3–4, the case 10 includes a first case portion 14 (or "box portion") and a second case portion 16 (or "cover portion"). When the case 10 is closed, the first and second case portions 14, 16 are mated together to form an enclosure 18 for storage of the palette 12. A substantially airtight seal is provided around the enclosure 18 by a gasket and magnetic means associated with the first and second case portions 14, 16.

The inner side of the first case portion 14 has a compartment 22 for placement of the palette 12. When placed in the compartment 22, the palette 12 sits on a frame 24 located on the inner side of the first case portion 14. The frame 24 defines an inner storage compartment 26 and an outer storage compartment 28, each of which may be used to store paint tubes, brushes, and other supplies. When the palette 12 is placed in the compartment 22, the palette 12 is secured to the frame 24 by VELCRO® hooks and loops fasteners 30 attached to the underside of the palette 12 and to the top of the frame 24. The stored palette 12 serves as a cover for the inner and outer storage compartments 26, 28. The depth of the inner and outer storage compartments 26, 28 is sufficient to allow the storage of paint tubes and brushes but is preferably no more than 2 inches so as to limit the evaporation of moisture from the paint and so as not to render the case unduly cumbersome.

As best seen in FIG. 4, the wall 32 of the compartment 22 in the first case portion 14 is configured so that the perimeter of the compartment 22 is slightly larger than the perimeter of the palette 12. Thus, the wall 32 of the compartment 22 serves to guide the palette 12 into the compartment 22 such that the VELCRO ® hooks/-loops 30 on the underside of the palette 12 are aligned with the VELCRO ® hooks/loops 30 on the top of the frame 24. This configuration enables a user to quickly secure the palette 12 in the case 10 without having to take time to match the hooks/loops on the palette 12 with the hooks/loops on the frame 24. As shown in FIG. 3, the palette 12 is substantially rectangular and has two rounded finger openings 34 formed at opposite sides across the width of the palette 12 to facilitate insertion and removal of the palette 12 into and from the case 10, respectively. The palette 12 preferably is made of plastic, such as acrylic, but numerous other materials may be used.

A seal support surface 36 is provided around the periphery of the compartment 22. A magnet 38, having a frame-like configuration, is secured, e.g., with adhesive, to the seal support surface 36 around the entire periphery of the compartment 22. A gasket 35, having a frame-like configuration, is disposed above the magnet 38 around the entire periphery of the compartment 22. The magnet 38 may be formed as a unitary piece or by cutting strips of magnetic material, beveling the ends, and joining the strips together, e.g., with adhesive. Likewise, the gasket 35 may be formed as a unitary piece or by joining strips of gasket material together. In the preferred embodiment, stock magnetized gasket material with adhesive backing is used. This material has a magnet enclosed within a rubber housing having an accordion-like structure underlying the magnet. The accordion-like structure of the lower portion of the rubber housing provides a cushioning effect when a user closes the case. When stock magnetized gasket material is used, the material preferably is placed on the first case portion (i.e., box portion) of the case. The functions of the gasket 35 and the magnet 38 are discussed later herein.

When the case 10 is closed, a cover 40 on the second case portion 16 covers the palette 12 stored in the compartment 22 in the first case portion 14. The cover 40 has a width and a length approximately the same as the width and the length of the compartment 22 in the first case portion 14. The depth of the cover portion 40 is sufficient to allow a reasonable amount of wet paint or other material to be stored on the palette 12 without contact between the cover 40 and the material when the case 10 is closed. The inventor has found that a distance in the range of 1.5 to 2.0 inches is preferable to prevent contact between the paint and the cover when the case is closed, while at the same time limiting the evaporation of moisture from the paint. The inner side of the second case portion 16 is provided with a seal support surface 42 around the perimeter of the cover 40. A magnet 44 having a frame-like configuration is secured, e.g., by adhesive, to the seal support surface 42 around the entire periphery of the cover 40. The magnet 44 has opposite polarity of the magnet 38. Alternatively, instead of the magnet 44, ferric metal (not shown) may be provided around the periphery of the cover 40.

When the case 10 is closed, that is, when the first and second case portions 14, 16 are mated together to enclose the palette 12 in the enclosure 18, the magnet 38 on the first case portion 14 and the magnet 44 on the second case portion 16 attract each other to contact the gasket from opposite sides thereof and form a substantially airtight seal around the enclosure 18 such that wet paints and other materials may be stored on the palette 12.

Paints and other wet materials on an open palette dry out because moisture in the material evaporates into the ambient environment. Molecules in the paint are constantly colliding and exchanging energy. Evaporation results when a molecule receives energy in a collision such that the molecule has sufficient energy to overcome attractive forces of neighboring molecules and escape into the gaseous phase. Evaporation can be substantially eliminated by creating a confined environment for the materials on the palette. When a confined environment is created, some liquid molecules will still escape from the paint into the gaseous phase, that is, some moisture will evaporate. However, the molecules that escape are trapped in the limited space of the confined environment. As molecules accumulate in the space above the paint, the likelihood of some molecules returning in their random motion to the paint increases. Eventually, a point of dynamic equilibrium is reached, i.e., a point at which molecules are returning to the paint at the same rate that molecules are leaving the paint. At the point of dynamic equilibrium, the moisture content of the paint remains substantially constant.

The rate of evaporation of paint on a palette is affected by the surface area the paint and the volume of the confined environment. The greater the surface area of the paint, the greater the number of molecules that are near the surface of the paint, and thus the greater the number of molecules that potentially may escape into the gaseous phase. The greater the volume of the confined environment, the more evaporation will occur before a state of dynamic equilibrium is achieved.

The present invention provides a controlled humidity environment for temporary storage of paint. Although the palette surface is flat, paint spread on the palette is generally irregular in shape. Even so, the surface area of the paint-side of the palette provides a general limit on the surface area of paint spread on the palette. The dimensions of the first and second case portions define the dimensions of the confined environment within the closed case, and thus determine a general limit on the amount of evaporation that will occur before dynamic equilibrium is achieved. Hence, the surface area of the palette and the volume of the confined environment interact to affect the rate and amount of evaporation of moisture from paint on the palette. For purposes of portability and ease of use and so as to limit the evaporation of moisture from paint stored on the palette, the ratio of volume of the confined environment to palette surface area is preferably less than or equal to 4.0. That is, the case preferably is configured such that:

$V/S \leqq 4.0$ wherein V = volume of the confined environment, and S = surface area of the paint-side of the palette.

If the ratio of volume of the confined environment to palette surface area is excessive, the rate of evaporation is such that the amount of time that paints can be preserved is reduced. Also, the case becomes more cumbersome to carry and use.

The present invention is especially well-suited for the temporary storage of oil paints. It has been the experience of the inventor that certain paints, particularly some dark-colored paints (e.g., black, umber), dry out within a matter of hours. The inventor has found that the case of the present invention, dimensioned such that the ratio of the volume of the palette storage enclosure to the surface area of the paint-side of the palette is less than 4.0, is capable of storing some quick-drying wet paints, such as black and umber, for at least three days. Since serious artists paint on a daily or near-daily basis, three days' temporary storage capability is adequate. It has also been the experience of the inventor that certain paints, particularly some light-colored paints (e.g., yellow) dry out more slowly. The inventor has found that the case of the present invention, dimensioned such that the ratio of the volume of the palette storage enclosure to the surface area of the paint-side of the palette is less than 4.0, is capable of storing some slow-drying wet paints, such as yellow, for at least as long as six weeks.

In the preferred embodiment, the first and second case portions 14, 16 are pivotably connected by hinges 45. A number of conventional hinges may be used. One low-cost and lightweight option that has been found to work well is to connect the first and second case portions 14, 16 by a pair of durable fabric straps (e.g., made from canvas webbing), each strap having one end secured to the outside of the first case portion 14 and the other end secured to the outside of the second case portion 16. If the straps are bolted to the case portions, it is necessary to fill the bolt holes with sealant so to maintain the controlled humidity environment in the case. Also, the first and second case portions 14, 16 are preferably molded from a durable, plastic material. However, numerous materials may be used. The molding of plastic is well known in the art and is not discussed herein.

Moreover, in the preferred embodiment, each of the first and second case portions 14, 16 is provided with a handle 50. Each of the handles 50 may be formed integrally with the respective case portion or separately attached. One low-cost and lightweight option that has been found to work well is to attach handles made from a durable fabric such as canvas. Although the illustrated embodiment shows two handles, in the case in which the handles are formed integrally with the case 10, only one handle may be provided.

Figure 1:
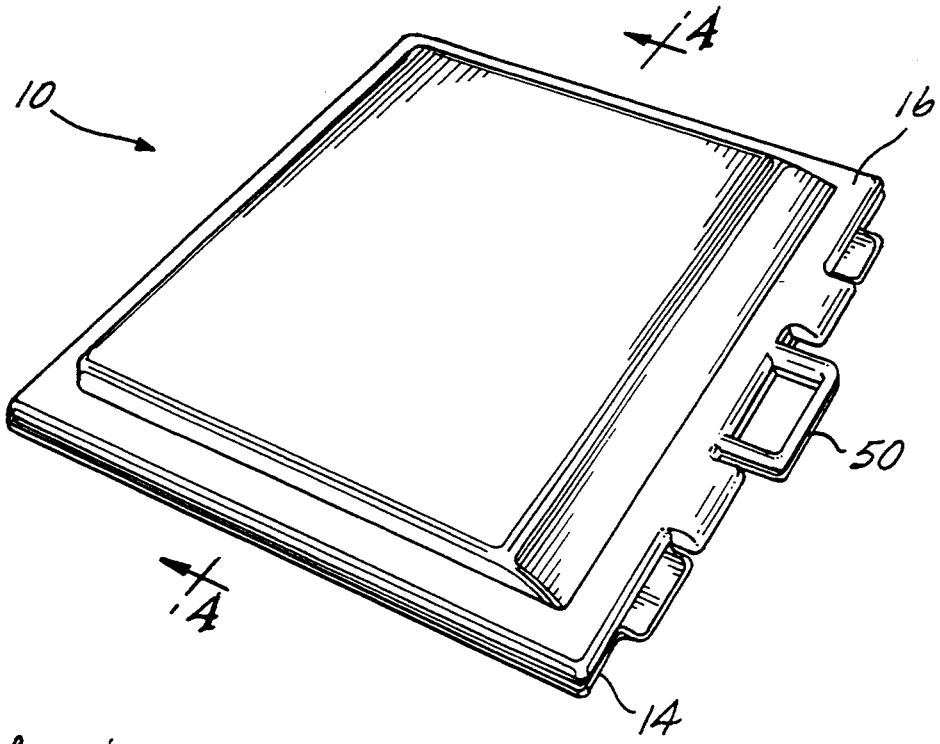
FIG. 1 is a perspective view of a case according to the present invention, with the case being closed and the cover portion being face-up.
Figure 2:
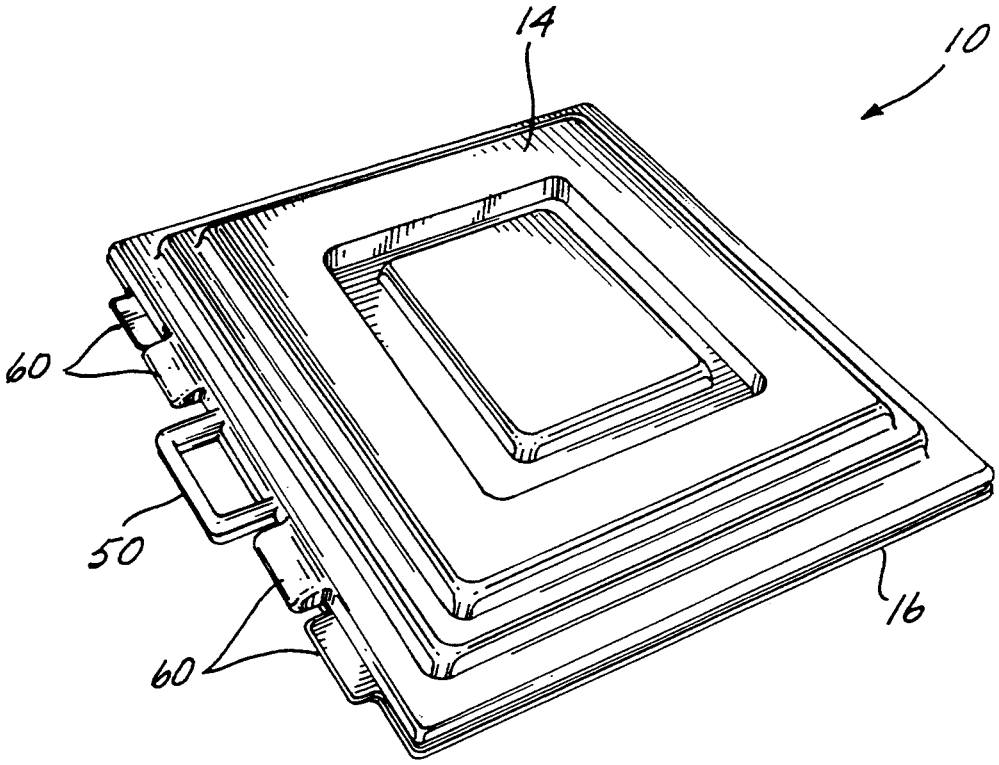
FIG. 2 is perspective view of the case illustrated in FIG. 1, with the box portion being face-up.

Each of the first and second case portions 14, 16 is provided with a pair of finger tabs 60. When the case 10 is closed, each tab 60 on the first case portion 14 is offset from the corresponding tab 60 on the second case portion 16 as shown in FIGS. 1 and 2. The two pairs of offset tabs 60 facilitate opening of the case 10. A user may simply push the tabs 60 apart to break the magnetic seal and open the case 10. In the preferred embodiment, each tab 60 is formed by molding a concave extension on the respective case member and then filling the concavity by securing a piece of neoprene, or other firm, durable material, to the concavity walls.

The case 10 can accommodate more than one palette. For example, two half-sized palettes may be used, the two half-sized palettes together forming a cover for the storage compartments 26, 28. Also, the case 10 may be provided with foldable legs for holding the palette 12 during use. The foldable legs may be stored in one of the storage compartments 26, 28.

The preferred embodiment of the present invention has been described above. However, it should be apparent that various modifications may be made without departing from the spirit and scope of the invention. For example, the first and second case portions and the palette may be formed in various shapes and configurations.

The embodiments of the invention in which an exclusive property or privilege is claimed are defined as follows:

1. A case for carrying a palette having a surface for the spreading of paint and other wet materials, the surface having an area S, wherein the case provides a controlled humidity environment for the temporary storage of paint and other wet materials on the palette when the case is closed, the case comprising:

a first case portion;

a second case portion adapted to be mated to the first case portion when the case is closed to form an enclosure for storage of the palette:

a gasket disposed between the first and second case portions around the periphery of the enclosure;

a first magnet disposed on the first case portion around the periphery of the enclosure; and a second magnet disposed on the second case portion around the periphery of the enclosure, the second magnet having opposite polarity relative to the first magnet, the magnetic attraction of the first and second magnets causing the first and second case portions to contact the gasket at opposite sides thereof to form a substantially airtight seal around the enclosure when the case is closed;

wherein (a) the first case portion comprises an inner side, the inner side of the first case portion comprising a compartment for placement of the palette, and the second case portion comprises an inner side, the inner side of the second case portion comprising a cover for covering the palette; and (b) the first magnet is secured to the inner side of the first case portion around the entire periphery of the compartment and the second magnet is secured to the inner side of the second case portion around the entire periphery of the cover; and wherein a first fastener is attached to the inner side of at least one of the first and second case portions, the first fastener cooperating with a second fastener on the palette to secure the palette within the case.

2. The case of claim 1 wherein the enclosure has a volume V such that the ratio of V to S is less than or equal to 4.0.

3. The case of claim 1 wherein the distance between the inside of the case and the surface of the palette when the case is closed is in the range of 1.5 to 2.0 inches.

4. The case of claim 1 wherein the first case portion is pivotably connected to the second case portion.

5. The case of claim 1 wherein the first case portion comprises a frame member located on the inner surface thereof for support of the palette, the frame member forming at least one storage compartment that is covered by the palette when the palette is placed on the frame member.

6. The case of claim 1 wherein the compartment has a depth less than or equal to 2 inches.

7. The case of claim 1 wherein the first and second fasteners are hooks/loops fasteners.

8. A case for carrying a palette having a surface for the spreading of paint and other wet materials, the surface having an area S, wherein the case provides a controlled humidity environment for the temporary storage of paint and other wet materials on the palette when the case is closed, the case comprising:

a first case portion;

a second case portion adapted to be mated to the first case portion when the case is closed to form an enclosure for storage of the palette, the second case portion comprising ferric metal around the periphery of the enclosure;

a gasket disposed between the first and second case portions around the periphery of the enclosure; and a magnet disposed on the first case portion around the periphery of the enclosure, the magnetic attraction of the magnet to the ferric metal causing the first and second case portions to contact the gasket at opposite sides thereof to form a substantially airtight seal around the enclosure when the case is closed;

wherein one of the first and second case portions comprises a compartment for placement of the palette, and the other of the first and second case portions comprises a cover for covering the palette; and wherein a first fastener is attached to at least one of the first and second case portions, the first fastener cooperating with a second fastener on the palette to secure the palette within the case.

9. The case of claim 8 wherein the enclosure has a volume V such that the ratio of V to S is less than or equal to 4.0.

10. The case of claim 8 wherein the distance between the inside of the case and the surface of the palette when the case is closed is in the range of 1.5 to 2.0 inches.

11. The case of claim 8 wherein the first case potion is pivotably connected to the second case potion.

12. The case of claim 8 wherein the first case portion comprises a frame member located on the inner surface thereof For support of the palette, the frame member forming at least one storage compartment that is covered by the palette when the palette is placed on the frame member.

13. The case of claim 8 wherein the storage compartment has a depth less than or equal to 2 inches.

14. The case of claim 8 wherein the first and second fasteners are hooks/loops fasteners.

* * * * *